US011019970B2

(12) United States Patent
Tian et al.

(10) Patent No.: US 11,019,970 B2
(45) Date of Patent: Jun. 1, 2021

(54) APPLIANCE FOR VACUUM CLEANING

(71) Applicant: Ningbo Beari Electric Co. Ltd., Ningbo (CN)

(72) Inventors: Jichuan Tian, Ningbo (CN); Jianfeng Hu, Ningbo (CN); Bo Xiang, Ningbo (CN)

(73) Assignee: Ningbo Beari Electric Co. Ltd., Ningbo (CN)

( * ) Notice: Subject to any disclaimer, the term of this patent is extended or adjusted under 35 U.S.C. 154(b) by 0 days.

(21) Appl. No.: 15/579,083

(22) PCT Filed: Nov. 30, 2017

(86) PCT No.: PCT/CN2017/113963
§ 371 (c)(1),
(2) Date: Dec. 1, 2017

(87) PCT Pub. No.: WO2018/103587
PCT Pub. Date: Jun. 14, 2018

(65) Prior Publication Data

US 2019/0282053 A1 Sep. 19, 2019

(30) Foreign Application Priority Data

Dec. 6, 2016 (CN) ..... 201611106166.7

(51) Int. Cl.

| | |
|---|---|
| ***A47L 9/24*** | (2006.01) |
| ***A47L 5/26*** | (2006.01) |
| *A47L 9/28* | (2006.01) |
| *A47L 9/06* | (2006.01) |

(Continued)

(52) U.S. Cl.
CPC ..... *A47L 9/244* (2013.01); *A47L 5/26* (2013.01); *A47L 9/246* (2013.01); *A47L 9/248* (2013.01); *A47L 5/24* (2013.01); *A47L 9/06* (2013.01); *A47L 9/0606* (2013.01); *A47L 9/19* (2013.01); *A47L 9/24* (2013.01); *A47L 9/28* (2013.01); *A47L 9/2831* (2013.01); *A47L 9/2857* (2013.01)

(58) Field of Classification Search
CPC . A47L 9/244; A47L 5/26; A47L 9/246; A47L 9/248; A47L 5/24; A47L 9/0606; A47L 9/19; A47L 9/24; A47L 9/2831; A47L 9/06; A47L 9/28
USPC ..... 15/323, 327, 344, 350; 137/355.26
See application file for complete search history.

(56) References Cited

U.S. PATENT DOCUMENTS 3,739,421 A * 6/1973 Fukuba ..... A47L 5/00 15/319
5,095,577 A * 3/1992 Jonas ..... A47L 9/0009 15/315

(Continued)

*Primary Examiner* — Monica S Carter
*Assistant Examiner* — Katina N. Henson

(57) ABSTRACT

The invention relates to a vacuum cleaner. The vacuum cleaner comprises a head portion; a body; a vacuum module positioned in the body, the vacuum module being adapted to generate suction for collecting dust via the head portion; a hose member adapted to connect the head portion with the vacuum module; and a guide member associated with the hose member; wherein the guide member is adapted to guide movement of the hose member such that, in response to movement of the guide member, the hose member automatically extends between a retracted position and an extended position to thereby position the head portion relative to the body.

19 Claims, 9 Drawing Sheets

(51) Int. Cl.
*A47L 9/19* (2006.01)
*A47L 5/24* (2006.01)

(56) References Cited

U.S. PATENT DOCUMENTS 5,199,996 A * 4/1993 Jonas ..... A47L 9/24
134/18
5,740,581 A * 4/1998 Harrelson, II ..... A47L 5/38
137/355.16
6,108,861 A * 8/2000 Vystrcil ..... A47L 5/32
15/315

* cited by examiner

APPLIANCE FOR VACUUM CLEANING

FIELD OF THE INVENTION

The invention relates to a vacuum cleaning appliance and particularly, but not exclusively, to a portable or hand-held electrical appliance for vacuum cleaning.

BACKGROUND OF THE INVENTION

Various types of electrical vacuum cleaning appliances, including cylindrical and hand-held vacuum cleaners, have been widely used in both domestic and industrial settings. A common vacuum cleaner generally comprises a main body having a vacuum pump and a dust collecting bag or chamber, and a pipe or hose for connecting the main body to a suction head. The required suction of the vacuum cleaner is generally provided by a partial vacuum generated by the vacuum pump, with any dirt, dust, debris or the like being sucked in and thereby lifted from a surface by the generated suction via the suction head. The lifted dirt is then conveyed along the connecting hose and subsequently filtered from the suction airstream and stored at the collecting bag or chamber for disposal.

To facilitate easy positioning of the suction head at a specific location to be cleaned, which can be any reachable surface ranging from, for example, floors, stairs, ceilings and/or surfaces of furniture, vacuum cleaners have typically been designed with a length adjusting functionality on the connecting handle or pipe of the suction head, such that the handle or the pipe can be lengthened or shortened as desired by the user to meet their specific cleaning needs. The length adjustment is generally conducted manually by the user, for example, by hand sliding of two telescopically connected handle or pipe units, followed by the manual locking of any movable parts of the handle or pipe units by a lock or the like to thereby fix the length of the extended or retracted handle or pipe units. In use and when a length adjustment of the handle or the pipe is required, the user will generally have to stop the cleaning activity, manually adjust the handle or the pipe to a newly desired length, and then manually lock the movable parts to again fix the length of the extended or retracted handle or pipe units before he or she can continue with the vacuum cleaning. The process is therefore understandably tedious and highly inconvenient for the user. In addition, the length adjustment available on a conventional vacuum cleaner may typically be restricted to a limited number of adjustment or connection points, for example, one to two extendable or retractable connection points. Accordingly, even where the handle or pipe of the vacuum cleaner is length adjustable, it is highly likely that the user will still have to, in practice, occasionally physically adjust his or her working distance from the location to be cleaned as a consequence of the fixed length of the extended or retracted handle or pipe units.

OBJECTS OF THE INVENTION

An object of the present invention is to provide a vacuum cleaner, in which the aforesaid shortcomings are mitigated or at least to provide a useful alternative.

Another object of the invention is to mitigate or obviate to some degree one or more problems associated with known appliances for vacuum cleaning.

The above object is met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In one main aspect, the invention provides a vacuum cleaner. The vacuum cleaner comprises a head portion; a body; a vacuum module positioned in the body, the vacuum module being adapted to generate suction for collecting dust via the head portion; a hose member adapted to connect the head portion with the vacuum module; and a guide member associated with the hose member; wherein the guide member is adapted to guide movement of the hose member such that, in response to movement of the guide member, the hose member automatically extends between a retracted position and an extended position to thereby position the head portion relative to the body.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which.

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the claims hereof, any element expressed as a means for performing a specified function is intended to encompass any way of performing that function. It is thus regarded that any means that can provide those functionalities are equivalent to those shown herein.

Figure 1:
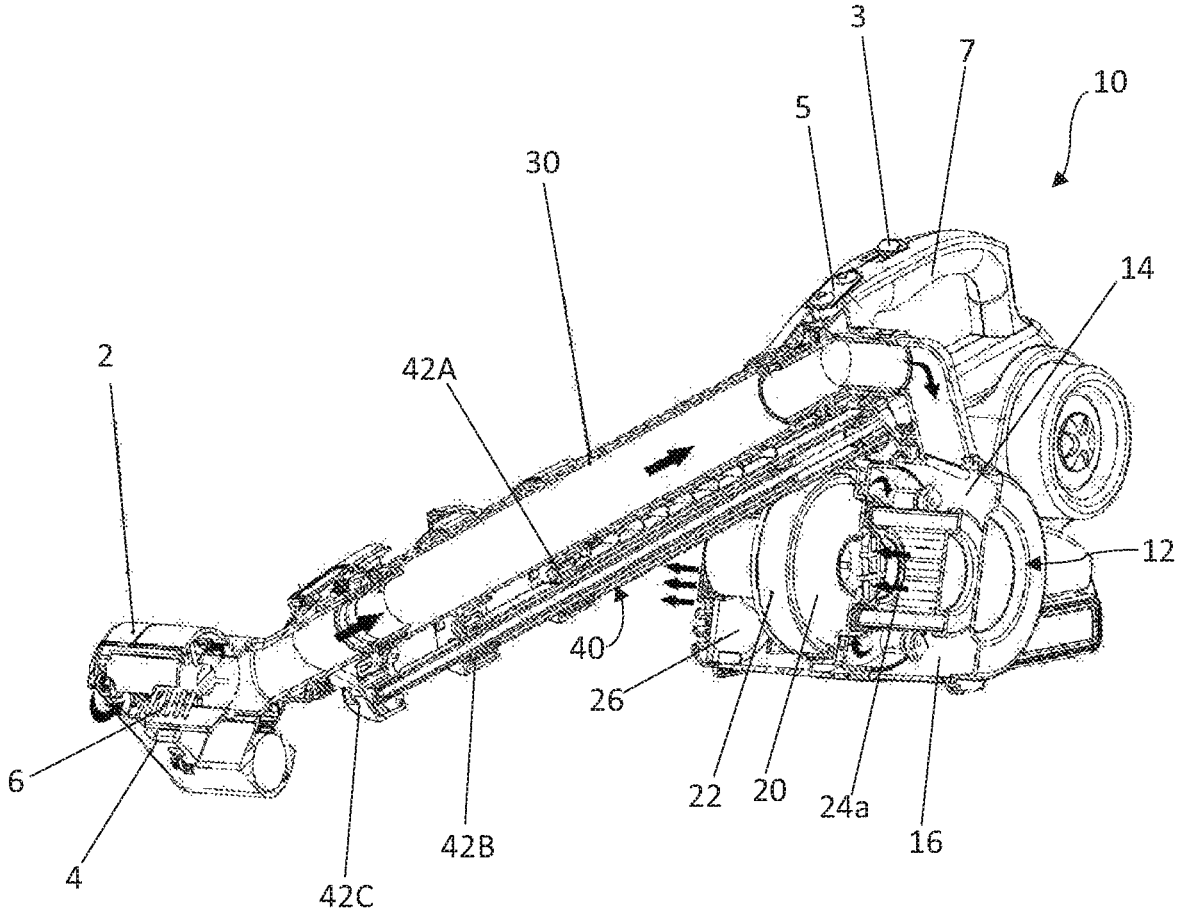
FIG. 1 is a perspective view showing a vacuum cleaner in accordance with an embodiment of the present invention.

Referring to FIG. 1, shown is an electrical appliance 10 for vacuum cleaning in accordance with an embodiment of the present invention. The vacuum cleaner 10 comprises a head portion or suction head 2 having an inlet 4 via which dirt, dust, debris or the like can be sucked in and received into the vacuum cleaner 10 via the suctioning action of the vacuum cleaner 10. As shown in the figure, one or more rotating brush member 6 can optionally be provided at or adjacent the inlet 4 to facilitate debris collection by the head portion 2 from a surface.

The vacuum cleaner 10 also comprises a main body 12, with a housing 14 of the main body 12 for encasing a number of functional parts including, but not limited to, a dust collection module 16 for receiving and storing the collected dust and debris; and a vacuum module 20 for generating the required suction force. In this embodiment, the vacuum module 20 may comprise a vacuum pump 22 for generating a partial or substantial vacuum for the suctioning action, and one or more dust filters such as, but not limited to, an air inlet filter 24*a* for filtering a dust-laden incoming air stream, and an air outlet filter 24*b* for filtering an outgoing air stream, for example.

Connecting the head portion 2 with the main body 12, and more specifically, the vacuum module 20 of the main body 12 is a hose member 30 as shown in the figure. The hose member 30 may be a flexible, corrugated vacuum hose member of known type. In this embodiment, the hose member 30 is preferably in the form of a stretchable hose, pipe, tube or the like being made of one or more resilient materials such as plastics, for example, polyvinyl chloride (PVC) for its durability and flexibility. The stretchability of the hose member 30 affords positioning of the head portion 2 relative to the main body 12, that is, allows the head portion 2 to be extended away from or retracted towards the main body 12. Although a specific example of the hose member 30 has been described in this embodiment, a person skilled in the art would understand that any variations to the hose member in terms of, for example, size, configuration, construction and/or material, are also encompassed as long as the variations are considered suitable and applicable without departing from the inventive concept of the present invention. For example, in an alternative embodiment, the hose member 30 can be provided in the form of a tube like structure comprising a plurality of tubular units telescopically movable relative to one another. The telescopic movement of the tubular units allows the required extendibility or stretchability of the hose member 30.

Specifically, the hose member 30 is arranged with a guide member 40, with the guide member 40 being capable of guiding movement of the hose member 30, such that, in response to movement of the guide member 40, the hose member 30 automatically extends/retracts, i.e. stretches/collapses, between a retracted position and an extended position to thereby position the head portion 2 relative to the main body 12. Preferably, the guide member 40 is arranged substantially parallel to and is extendable/retractable along a same direction of extension/retraction as the hose member 30. Preferably, the extension of the guide member 40 is extendable/retractable along a handle 7 of the vacuum cleaner 10 to thereby allow the hose member 30 to serve, in effect, as an extended length of the user's arm when the vacuum cleaner is being held at the handle 7 by the user.

Figure 2:
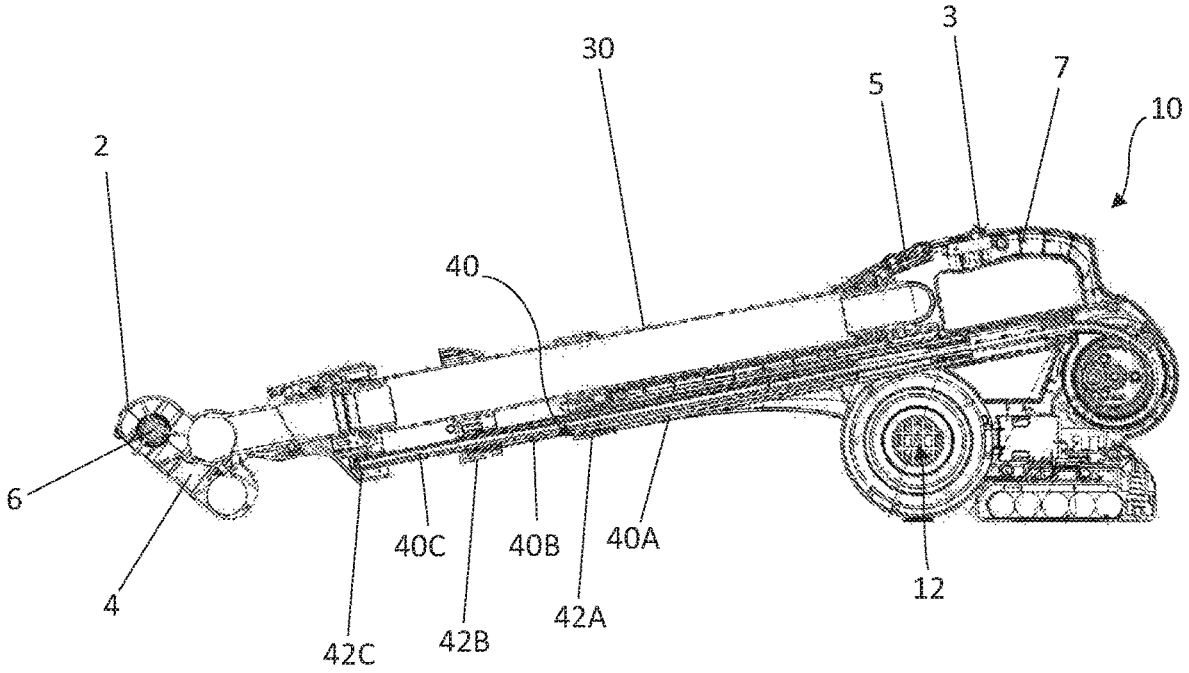
FIG. 2 is a side cross-sectional view showing the vacuum cleaner of FIG. 1.

In the embodiment as shown in FIGS. 1 and 2, the guide member 40 may comprise a plurality of guide units 40A, 40B and 40C movably associated with one another to thereby extend and retract the guide member 40 along an extension axis parallel to a longitudinal axis of the hose member 30. The plurality of guide units 40A, 40B and 40C may comprise a plurality of elongated sub-units slidably connected with one another, and more preferably, the plurality of guide units 40A, 40B and 40C may comprise a plurality of tubular structures telescopically connected with one another to thereby extend or retract along the extension axis, as more clearly shown in FIG. 2. In one embodiment, the guide units of the guide member 40 can be formed of any suitable materials such as, but not limited to, polymers and/or metals, and preferably, aluminum for its relatively high physical strength and light weight.

Figure 3:
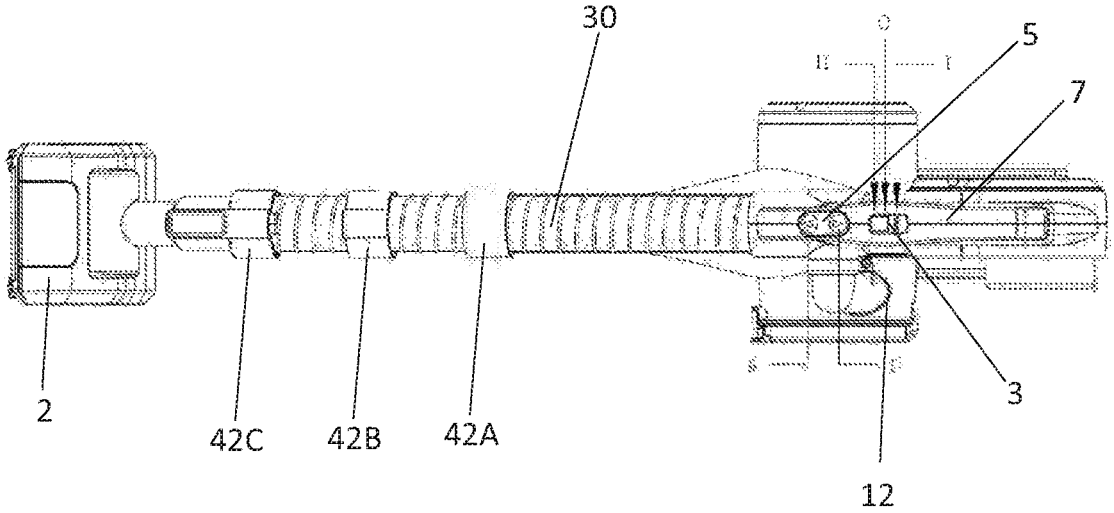
FIG. 3 is a top view showing the vacuum cleaner of FIG. 1.

Preferably, at least one of the plurality of guide units 40A, 40B and/or 40C is arranged relative to the hose member 30 via at least one positioning means 42. In one embodiment, the positioning means 42 can be fixedly connected between part of the hose member 30 and one or more of the plurality of guide units 40A, 40B and/or 40C. Alternatively, the positioning means 42, such as the positioning means 42A, 42B and 42C as shown in FIGS. 1 and 2, can be arranged at the respective guide units 40A, 40B and 40C of the guide member 40 for providing support to and thereby positioning the hose member 30. Preferably, the positioning means 42A, 42B and 42C may comprise or be provided in the form of one or more ring or sleeve members connecting to the respective guide units 40A, 40B and 40C at one end, and receiving at least partially the hose member 30 at the other end, as illustrated in FIG. 3.

Likewise, although specific arrangements of the guide member 40 and the positioning means 42 have been described in the various embodiments, it will be understood by a skilled person in the art that any variations to the guide member and/or the positioning means in terms of, for example, sizes, configurations, constructions and/or materials, should also be encompassed by the present invention, as long as the variations are considered suitable and applicable without departing from the inventive concept of the present invention.

Figure 4:
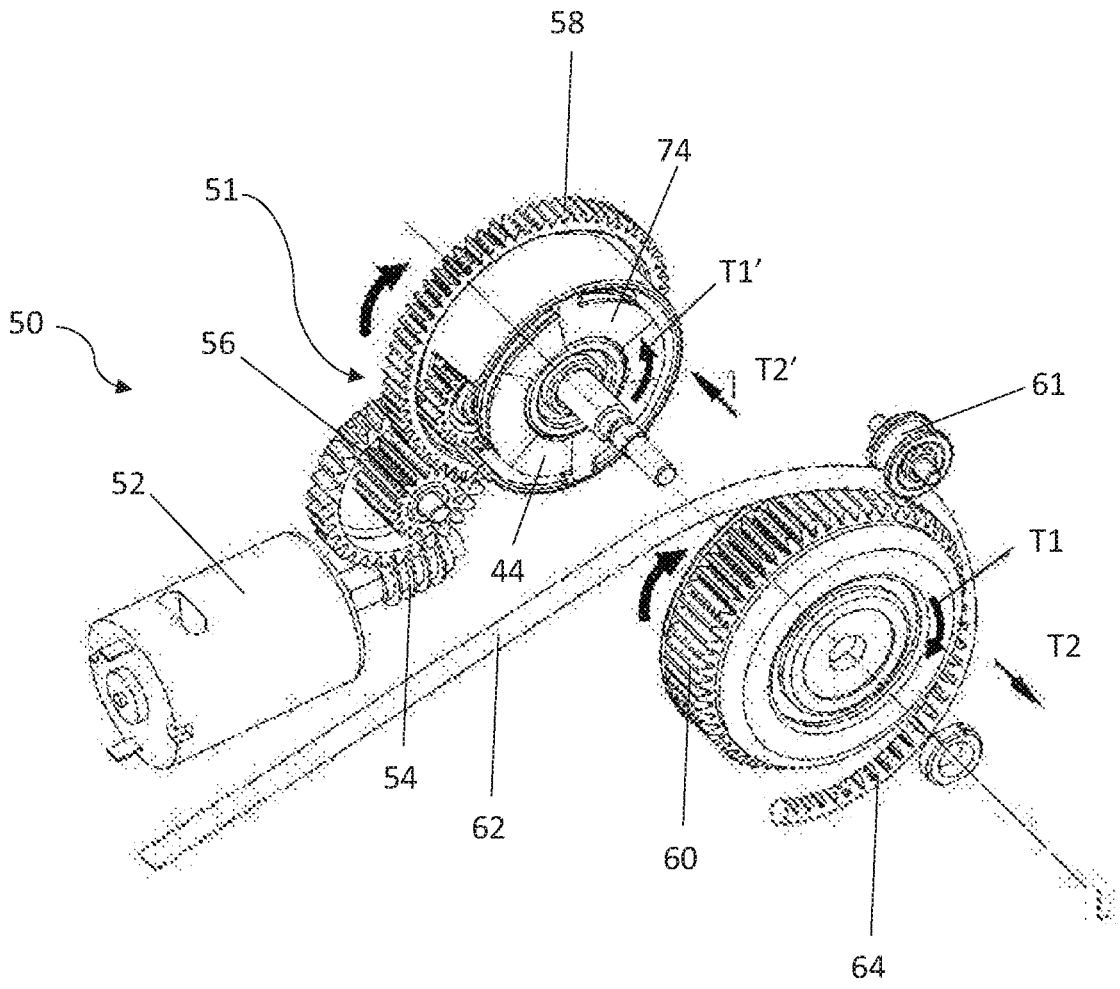
FIG. 4 is an exploded view showing a belt member and a gear system of a control module of the vacuum cleaner of FIG. 1, with an output gear of the gear system rotating in a first direction.
Figure 5:
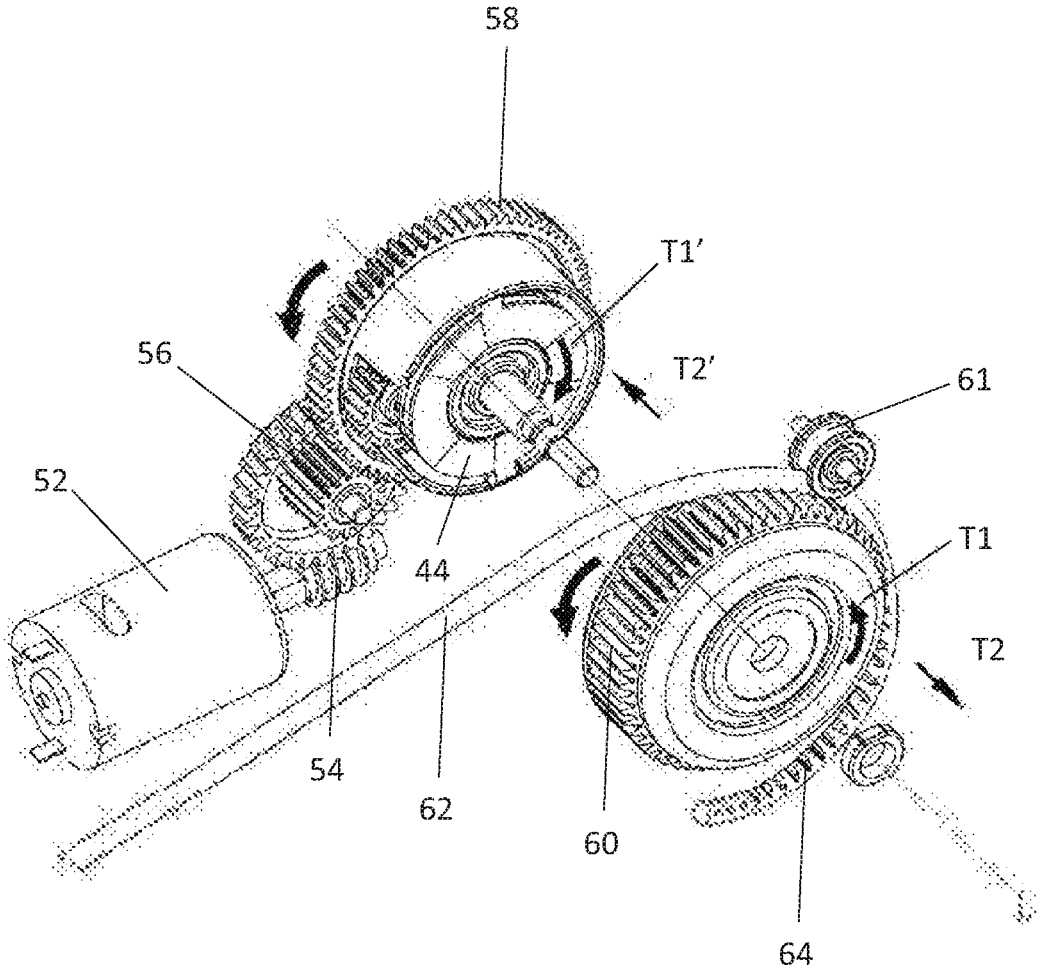
FIG. 5 is an exploded view showing the arrangement of FIG. 4, with the output gear rotating in a second direction.

Preferably, the guide member 40 is controllable by a control module 50 actuatable by but is not limited to electrical power. For example, the control module 50 may comprise one or more transmission systems operable under one or more of an electric mechanism, a hydraulic mechanism, a pneumatic mechanism and/or an electromagnetic mechanism. In one embodiment, the control module 50 may comprise a mechanical transmission system having an electrically powered motor 52 with its output shaft 54 mechanically connecting with a gear system 51 comprising a series of gear members such as gears 56, 58 and 60, as shown in FIGS. 4 and 5. Preferably, the gear system 51, and particularly the output gear 60, is arranged to engage with an elongated member 62 connected at one end with the guide member 40 thereby causing movement of the guide units in response to movement of the elongated member 62. In one embodiment as shown in the figures, the elongate member 62 is preferably made of a flexible material and may comprise at least one belt member 62. More preferably, the belt member 62 is a toothed belt member 62 thereby allowing engagement of the teeth 64 of the belt member 62 with the gear system 51 such as the corresponding teeth of the output gear 60 at the other end portion of the belt member 62. Optionally, a positioning wheel 61 can be provided to position the belt member 62 relative to the output gear 60 to thereby ensure close engagement between the belt member 62 with the output gear 60.

In one embodiment, the belt member 62 can be arranged to connect with the gear system 51 of the control module 50 at one end, with the other end connected with one or more of the guide units 40A, 40B and/or 40C of the guide member 40, as shown in FIG. 2. A portion of the belt member 62 intermediate its ends preferably runs along at least part of the length of the guide member 40. The belt member 62 may preferably be positioned within and along a hollow center of the guide member 40, with the belt member 62 being arranged to be closely confined, and yet moveable within the hollow center of the guide member 40. The closely confined arrangement can be provided by having the belt member 62 having a shape generally configured to be in conformity with the shape of the interior of, for example, the tubular structure of the guide member 40, such that any unintended movement such as a sideways movement and/or folding of the belt member 62 within the hollow center of the tubular guide member 40 being reduced, minimized or avoided. Since the belt member 62 is arranged to connect with at least an end one of the guide units of the guide member 40, rotational movement of, for example, the engaged output gear 60 will cause movement of the belt member 62 along its longitudinal axis, which will in turn cause the connected guide units 40A, 40B and 40C to move along the same direction. More specifically, longitudinal movement of the belt member 40 will result in telescopic movement of one or more of the guide units 40A, 40B and 40C relative to one another, to thereby allow extension or retraction of the guide member 40 dependent on the direction of movement of the belt member 62. Preferably, the flexible belt member 62 is of a sufficient rigidity to avoid easy dislocation or folding of the belt member 62 within the guide member 40 during the belt movement, which may further be assisted by the closely confined but moveable arrangement of the belt member 62 within the guide member 40. In one alternative embodiment, the belt member 62 can be positioned external to the guide member 40, for example, by being connected thereto via several connection points at a side wall of the guide units of the guide member 40.

Figure 6:
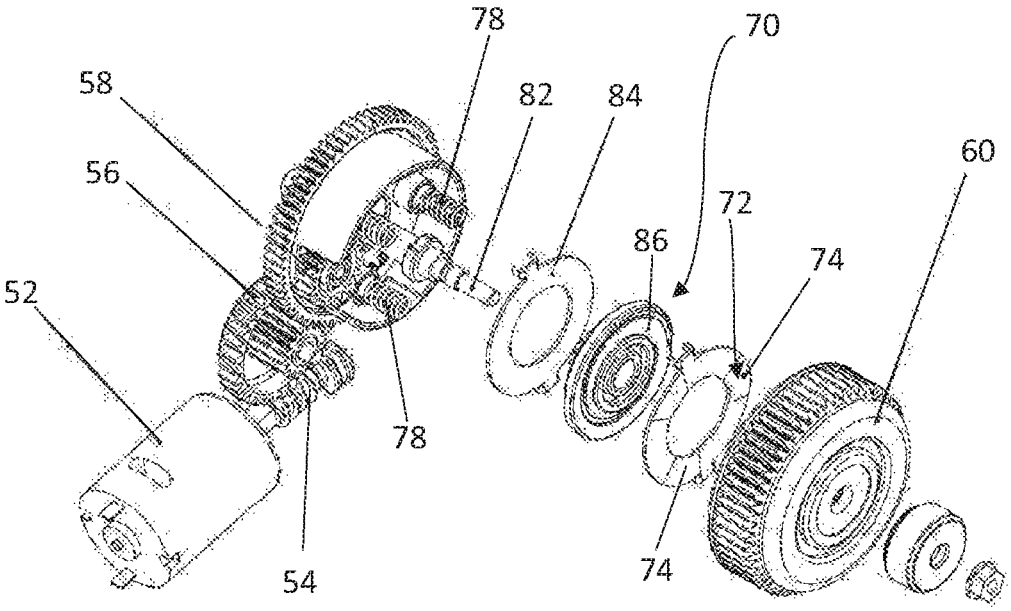
FIG. 6 is an exploded view showing a clutch system of the control module of the vacuum cleaner of FIG. 1.
Figure 7:
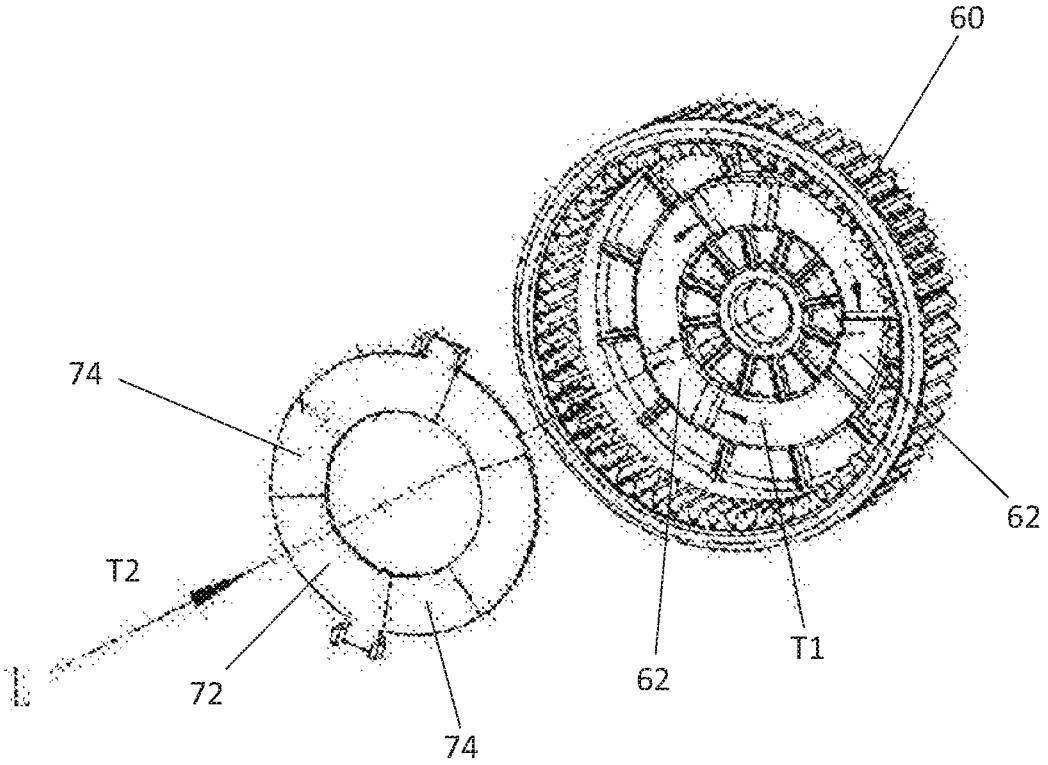
FIG. 7 shows the clutch plate and the output gear of FIG. 6.

In one further embodiment, the control module 50 may comprise at least one clutch system 70 having at least one clutch plate 72 engageable with the gear system 51 such as the output gear 60 as shown in FIGS. 6 and 7. The clutch plate 72 can be provided with one or more protrusions and/or recesses 74 which conform or match with the corresponding protrusions and/or recesses 62 at the output gear 60 for engagement therewith. For example, the protrusion and/or recess 74 can be trapezoidal in shape, with each of the opposing inclined sides pointing towards a centre of the clutch plate 72 and each forming an inclination angle of, for example, less than or equal to about 45 degrees with a central, vertical axis. Alternatively, the clutch plate 72 and the output gear 60 may also be engageable via only friction between the corresponding contact surfaces of the clutch plate 72 and the output gear 60.

The clutch plate 72 is adapted to be biased against the output gear 60 via one or more biasing means 78, which can be provided in the form of one or more spring members 78, for example. In the embodiment as shown in FIG. 6, the spring members 78 are provided at a side of the gear 58, which mechanically connects the output shaft 54 of the motor 52 with the output gear 60 via the clutch system 70. A shaft 82 can be provided at the central axis of the gear 58 at the same side as the spring members 78 to connect the output gear 60 by sandwiching a number of intermediate plate members of the clutch system 70 in between. The plate members may include, but are not limited to, a spring plate 84, a mid plate 86 and the clutch plate 72. These intermediate plate members are positioned under the biasing action of, and are pressed towards the output gear 60 by the spring members 78.

In use and when the motor 52 is electrically actuated, rotation of the gear 58 will cause the connected output gear 60 to rotate in the same rotational direction. For example, a clockwise rotation of the gear 58 and thus a clockwise rotation T1 of the output gear 60 as shown in FIG. 4 will draw the belt member 62 towards the direction of the gear 60 to thereby retract the connected guide member 40 towards the main body 12; and an anticlockwise rotation of the gear 58 and thus an anticlockwise rotation T1 of the output gear 60 as shown in FIG. 5 will extend the belt member 62 away from the gear 60 to thereby extend the guide member 40 away from the main body 12. During a normal operation of the gear system 51 and thus the interconnected clutch system 70, the clutch plate 72 is rotatable under the driving action of the gear 58, and at the same time, arranged to bias towards the axial direction T2 towards the output gear 60 and thus, presses on and engages with the output gear 60. The driving rotation of the gear 58 thus causes the output gear 60 to rotate in the same direction as the gear 58 to extend or retract the guide member 40.

When the guide member 40 is telescopically extended to its maximum length of extension or is retracted to its minimum length of retraction, further extension or retraction of the guide member 40 will be physically prevented and thus resistance will be generated at the output gear 60. A counter rotation reaction force T1' as well as a counter axial reaction force T2' will be experienced by the clutch plate 72. Particularly, when the counter axial reaction force T2' is developed to become greater than the biasing force T2 provided by the spring members 78, the clutch plate 74 will be caused to disengage from the output gear 60, thereby preventing further rotation of the output gear 60. No further extension or retraction of the belt member 62 and thus, extension or retraction of the guide member 40 will result. The clutch system 70 is therefore beneficial in allowing an automatic disconnection of the output gear 60 with the drive of the transmission system when the telescopic movement of the guide member 40 has reached a certain maxima or minima, which may otherwise cause damage to the gear system 51, the motor 52 or even the vacuum cleaner 10.

Although the clutch system 70 of the control module 50 is described above as a specific embodiment, it is understandable that the present invention should not be limited to the exemplified system in providing the automatic disconnection of the transmission mechanism. For example, an integrated circuit breaker in any known form can be provided at the control module 50 to electrically disconnect the power supply to, and/or to stop the rotational driving force from the motor 52 thereby preventing further movement of the guide member 40.

Figure 8:
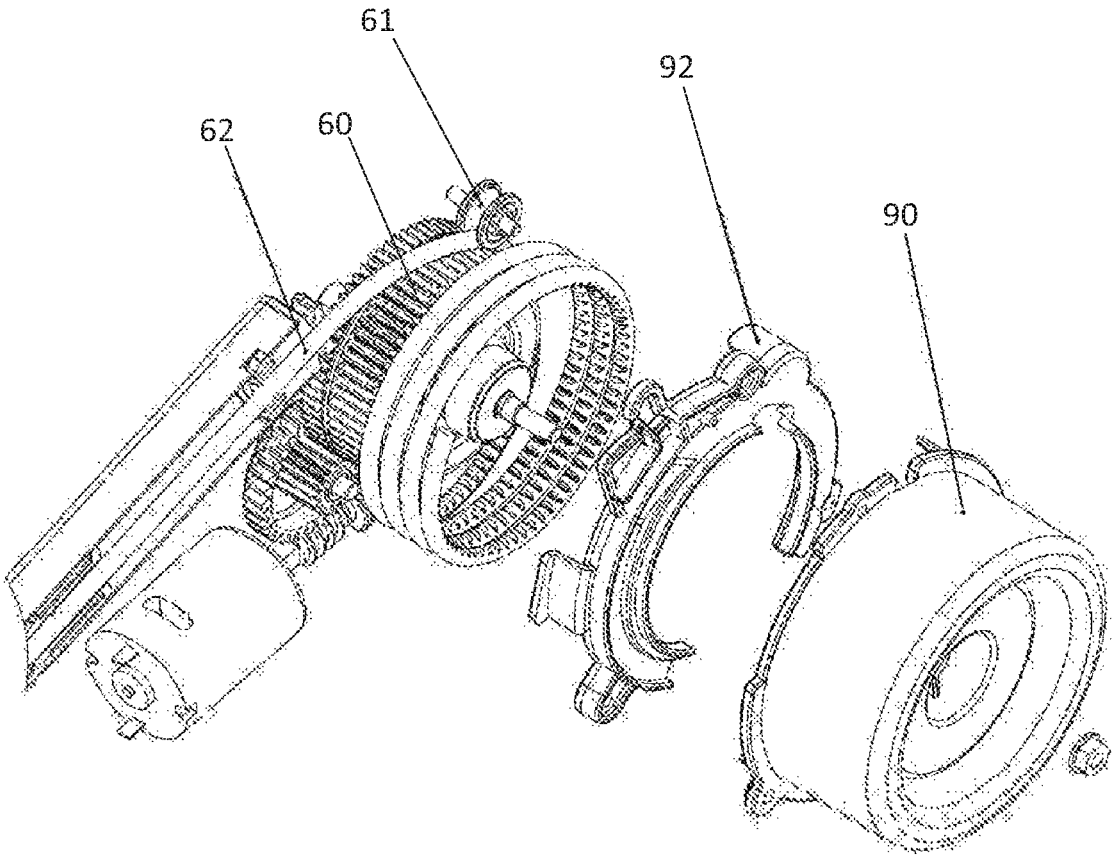
FIG. 8 is an exploded view showing the embodiment of FIG. 4 with a belt cover.
Figure 9:
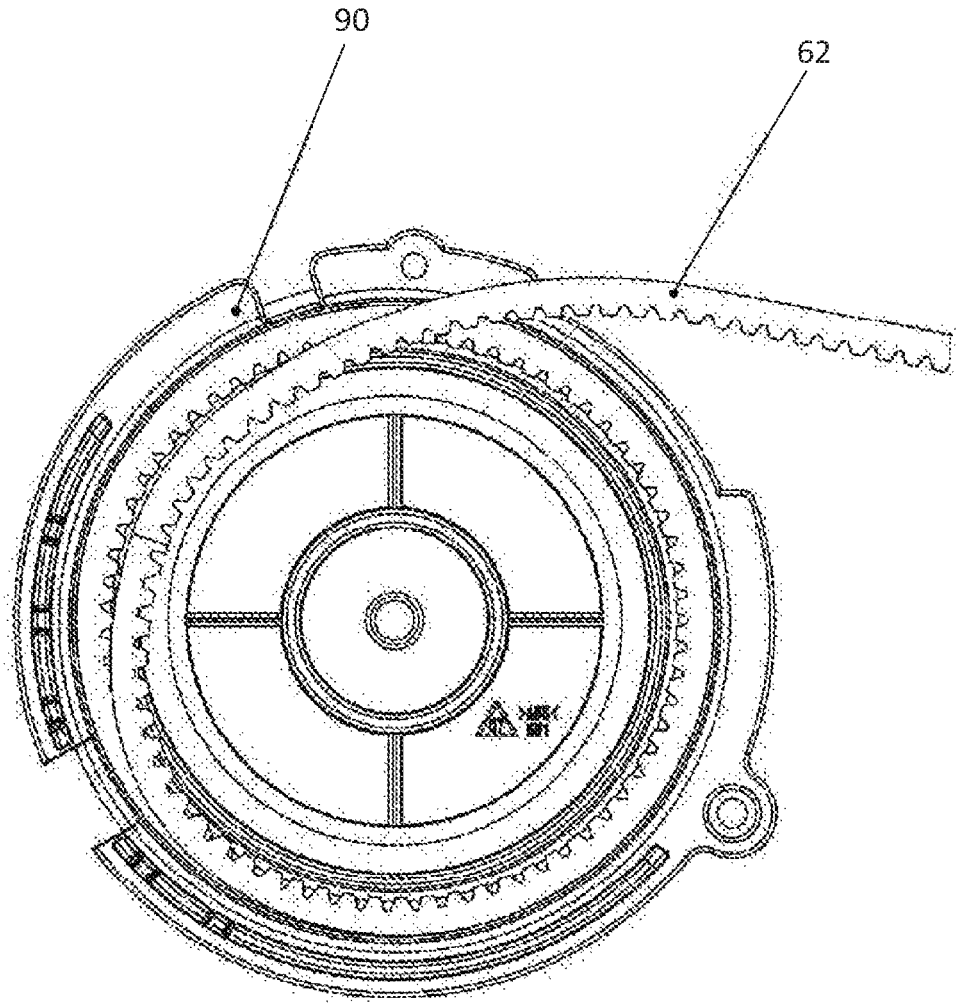
FIG. 9 is a front view showing the arrangement of the belt member in the belt cover of FIG. 8.

In one further embodiment, a wheel cap or belt cover 90 may optionally be provided to cover the output gear 60 and the engaged belt member 62 for protection, as shown in FIGS. 8 and 9. A belt clamp 92 may further be provided to secure position of the belt member 62 relative to the output gear 60 and the belt cover 90.

The vacuum cleaner 10 as embodied in the present invention may generally be powered by an AC power supply, but may optionally include a DC battery and/or a rechargeable battery pack as a supportive or alternative power source. As shown in FIGS. 1-3, the vacuum cleaner 10 may comprise a first, main switch 3 for controlling power supply to the vacuum cleaner 10, and a second switch 5 for actuating and controlling extension and retraction of the hose member 30. In one embodiment, the main switch 3 can be arranged to electrically connect with the vacuum module 20 to allow electric power supply to the vacuum pump 22, and the second switch 5 can be electrically connected with the control module 50 to provide electric power supply to the motor 52. The second switch 5 may further comprise forward and a backward buttons for controlling the extending and retracting movements of the guide member 40 and thus the hose member 30, respectively. Preferably, the first and the second switches 3, 5 can be connected with a same printed circuit board or different printed circuit boards to enable separate electrical control to the control module 50 and the vacuum module 20, so that the relevant parts such as the transmission system and the vacuum pump 22 can be operated and controlled independently. This is beneficial in allowing control to the extension and retraction of the hose member 30 be conducted regardless of the operating condition of the vacuum pump 22. The main switch 3 and the second switch 5 are positioned at or close to the handle for easy manual access by a thumb or a finger of a user holding the vacuum cleaner 10 in operation. Consequently, a user can automatically cause extension or retraction of the hose member to a desired length whilst the vacuum cleaner 10 is operating without having to change their hold on the handle of the vacuum cleaner 10.

In one further embodiment, the plurality of guide units of the guide member 40 are adapted to be manually movable relative to one another to thereby allow a manual, i.e. physical, extension and retraction of the hose member 30 along its extension axis. Particularly, one or more of the guide units 40A, 40B and 40C may further be manually positioned relative to one another and/or be locked in place via one or more corresponding manual locking means (not shown). Manual extension/retraction of the plurality of guide units and thus the hose may be assisted by configuring the clutch to disengage or the friction of the clutch to be overcome when said plurality of guide units are manually manipulated. The provision of a manual adjusting mechanism in addition to the automatic extension and retraction of the hose member controllable by the control module 50 allows further flexibility for the user to easily position the head portion 2 at the location to be cleaned.

Without limited by the described embodiments, it will be readily understood by a skilled person in the art that any variations to the vacuum cleaner in terms of, for example, dimensions, configurations, constructions, designs and/or materials forming one or more parts thereof, should also be encompassed by the present invention, as long as the variations are considered suitable and applicable without departing from the inventive concept of the present invention. For example, in one embodiment, the hose member 30 can be arranged to connect with the main body 12 via one or more connecting means such as one or more interconnected conduits which allow fluid communication between the hose member 30 and the vacuum module 20 of the main body 12. In this embodiment, the conduit is preferred to be releasably engageable with a holding portion provided at the housing 16 of the main body 12 such that, in use, the user is allowed to manually detach the conduit from the housing 16 thereby enabling further physical extension of the hose member 30 away from the main body 12. The conduit may further be formed of a stretchable material and/or be configured to be stretchable or extendable for additional extendibility. In one further embodiment, the vacuum module 20 may further be arranged to be releasably detachable from the main body 12 to thereby provide further flexibility to the user.

The present invention is advantageous in that it provides a vacuum cleaner, and particularly but not exclusively, a portable vacuum cleaner which is capable of automatically extending and retracting a hose connecting the suction head with the main body of the vacuum cleaner upon actuation of an electrical control module. No manual assembling and/or adjusting of the hose is required, although manual adjustment of the hose extension length amount may be optionally provided. The automatic adjustment is independently operable regardless of the operating condition of the vacuum cleaner, for example, the extension and retraction of the hose is controllable without the need of switching on or off the vacuum pump. Accordingly, the user may electrically adjust the length of the hose to position the suction head at any desired location to be cleaned without the need to power off the vacuum pump of the cleaner. The automatic extension and retraction also negates any manual locking and unlocking steps to the extendable or movable parts of the guide units and/or hose, which may otherwise interfere with the vacuum cleaning process. In addition, the automatic extension and retraction of the hose can be continuously controlled, that is, the length adjustment is not be restricted by any preset adjustment points or sessions of extension or retraction, but has an infinite length adjustability between its maxima and minima. The retractability of the hose further enables a more compact configuration of the vacuum cleaner, which allows easy and convenient handling of the hand-held vacuum cleaner during use, as well as to facilitate a more user-friendly storage of the vacuum cleaner after use. Furthermore, the clutch system of the present invention enables the transmission mechanism to stop automatically when the hose has reached its maximum length of extension or its minimum length of retraction. This is of particular significance in preventing the transmission mechanism and thus the vacuum cleaner from being damaged by excessive extension or retraction, and thus to ensure safety of the user.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. A portable, hand-held vacuum cleaner, comprising:

a handle;

a head portion;

a body;

a vacuum module positioned in the body, the vacuum module being adapted to generate suction for collecting dust via the head portion;

a hose member adapted to connect the head portion with the vacuum module, the hose member being stretchable to extend along a longitudinal axis of the hose member;

a guide member associated with the hose member, the guide member comprising a plurality of guide units movably associated with and are slidably movable over one another; the guide member being controllable by a control module actuatable by electric power, such that the plurality of guide units of the guide member are automatically slidably movable relative to one another between a minimum length of retraction and a maximum length of extension to guide movement of the hose member such that, in response to the sliding movement of the guide member, the hose member is guided to automatically stretch to extend between a retracted position and an extended position along the handle to thereby allow the hose member to function as an extended length of the user's arm when the vacuum cleaner is being held at the handle by the user;

the control module comprising:

an elongated belt member engageable with the plurality of guide units, wherein the elongated belt member is arranged to be positioned within and along a hollow center of the guide member;

a gear system having a plurality of gear members, the plurality of gear members comprise an output gear engageable with the elongated belt member, the gear system being rotatable to cause movement of the plurality of guide units in response to movement of the elongated belt member;

at least one clutch system having at least one clutch plate engageable with the gear system and is axially arranged with the output gear of the gear system; the clutch plate is provided with one or more protrusions which conform with corresponding recesses at the output gear for engagement therewith; the protrusions being trapezoidal in shape with opposing inclined sides pointing towards a center of the clutch plate;

wherein the at least one clutch plate is arranged to axially bias against and to engage the output gear of the gear system for transmitting rotation, thereby allowing movement of the plurality of guide units between the minimum length of retraction and the maximum length of extension; and that the at least one clutch plate is arranged to axially disengage from the output gear of the gear system thereby preventing rotation of the gear system when the plurality of guide units are retracted to the minimum length of retraction or extended to the maximum length of extension.

2. The vacuum cleaner according to claim 1, wherein the guide member is extendable along a same direction of extension as the hose member.

3. The vacuum cleaner according to claim 1, wherein the plurality of guide units are movably associated with one another to thereby extend and retract along an extension axis parallel to the longitudinal axis of the hose member.

4. The vacuum cleaner according to claim 3, wherein the plurality of guide units comprise a plurality of elongated sub-units slidably connected with one another to thereby extend or retract along the extension axis.

5. The vacuum cleaner according to claim 3, wherein the plurality of guide units comprise a plurality of tubular structures telescopically connected with one another to thereby extend or retract along the extension axis.

6. The vacuum cleaner according to claim 3, wherein at least one of the plurality of guide units is positioned relative to the hose member via at least one positioning member.

7. The vacuum cleaner according to claim 6, wherein the at least one positioning member is fixedly connected between the hose member and the at least one of the plurality of guide units.

8. The vacuum cleaner according to claim 6, wherein the positioning member is provided at the guide member for supporting position of the hose member.

9. The vacuum cleaner according to claim 6, wherein the at least one positioning member comprises a sleeve member.

10. The vacuum cleaner according to claim 1, wherein the control module comprises one or more transmission systems operable under one or more of an electric mechanism, a hydraulic mechanism, a pneumatic mechanism and an electromagnetic mechanism.

11. The vacuum cleaner according to claim 1, wherein the elongated belt member is arranged to run along at least part of a length of the guide member.

12. The vacuum cleaner according to claim 1, wherein the elongated belt member is flexible.

13. The vacuum cleaner according to claim 1, wherein the elongated belt member is arranged to be closely confined, but moveable within the hollow center of the guide member.

14. The vacuum cleaner according to claim 1, wherein the elongated belt member is a toothed belt member.

15. The vacuum cleaner according to claim 1, wherein the at least one clutch plate is adapted to be biased against the gear system via one or more spring members.

16. The vacuum cleaner according to claim 1, wherein the hose member comprises a resilient hose.

17. The vacuum cleaner according to claim 1, wherein the control module is operable independently from the vacuum module.

18. The vacuum cleaner according to claim 3, wherein the plurality of guide units are manually movable relative to one another to thereby extend and retract the guide member along the extension axis.

19. The vacuum cleaner according to claim 18, wherein the one or more of the plurality of guide units are adapted to be manually positioned relative to one another via one or more locking members.

* * * * *